US006158329A

United States Patent [19]

Schneider et al.

[11] Patent Number: 6,158,329

[45] Date of Patent: Dec. 12, 2000

[54] COOKING APPLIANCE WITH TEMPERATURE SENSOR

[75] Inventors: Marion Schneider, Ebersdorf; Martin Thaler, Oberteisendorf; Uwe Has, Unterneukirchen-Oberschroffen; Susanne Stolz, Kraiburg; Monika Zeraschi, Traunreut, all of Germany

[73] Assignee: BSH Bosch und Siemens Hausgeraete GmbH, Munich, Germany

[21] Appl. No.: 09/516,657

[22] Filed: Mar. 1, 2000

[30] Foreign Application Priority Data

Mar. 1, 1999 [DE] Germany ..... 199 08 800

[51] Int. Cl.[7] ..... A23L 1/00; A47J 37/00

[52] U.S. Cl. ..... 99/331; 99/339; 99/352; 99/355; 99/451; 99/468; 99/517; 99/DIG. 14; 219/400; 219/411; 219/710

[58] Field of Search ..... 99/326–333, 337, 99/339, 340, 352–355, 427, 400, 444–450, 451, 467, 468, 516, 517, DIG. 14; 126/25 R, 9 R; 219/400, 450.1, 411, 413, 686, 710, 388; 426/521, 523, 241, 242; 392/307

[56] References Cited

U.S. PATENT DOCUMENTS

| | | | |
|---|---|---|---|
| 3,501,620 | 3/1970 | Sauer | 219/400 X |
| 3,586,516 | 6/1971 | Terc | 219/400 X |
| 4,133,336 | 1/1979 | Smith | 126/21 A |
| 4,425,720 | 1/1984 | Elevitch | 99/450 X |
| 4,455,478 | 6/1984 | Guibert | 219/386 X |
| 5,111,012 | 5/1992 | Hyun et al. | 126/21 A |
| 5,160,829 | 11/1992 | Chang | 219/400 |
| 5,423,248 | 6/1995 | Smith et al. | 99/476 X |
| 5,458,050 | 10/1995 | Su | 99/446 X |
| 5,579,679 | 12/1996 | Hsu | 99/339 |
| 5,695,668 | 12/1997 | Boddy | 99/331 X |
| 5,699,722 | 12/1997 | Erickson et al. | 99/483 X |
| 5,765,471 | 6/1998 | Monard | 99/448 |

*Primary Examiner*—Timothy Simone
*Attorney, Agent, or Firm*—Herbert L. Lerner; Laurence A. Greenberg; Werner H. Stemer

[57] ABSTRACT

A cooking appliance has a cooking space for receiving a product to be cooked. The cooking space communicates with a cooling-air feeding device and with a sensor module which is provided for sensing a infrared radiation of a surface area under measurement located in the cooking space. The sensor module is disposed at least partially in an air stream provided by the cooling-air feeding device. Impairment of the measuring quality by the air stream is prevented by an extraction device that is provided for extracting air from the cooking space. The extraction device and the feeding device define an imaginary straight line joining a mouth opening of the cooling-air feeding device on the cooking space side and a mouth opening of the extraction device on the cooking space side being at a distance from the surface area under measurement.

12 Claims, 2 Drawing Sheets

COOKING APPLIANCE WITH TEMPERATURE SENSOR

BACKGROUND OF THE INVENTION

Field of the Invention

The present invention concerns a cooking appliance having a cooking space for receiving a product to be cooked. A cooling-air feeding device and a sensor module are provided for sensing an infrared radiation of a surface area of the product to be cooked or the interior of the cooking appliance.

Cooking appliances of the generic type allow the progress of the cooking process within a cooking space to be monitored on the basis of a contactless temperature measurement. This involves sensing the temperature of a surface area under measurement within the cooking space, that is to say for example the surface of the food prepared or a wall of the cooking appliance. Known for this purpose is the use of an infrared sensor, which however has to be protected against soiling and overheating to allow accuracy to be ensured. To achieve this, the infrared sensor is bathed in a cooling air flow. It is problematical that this is accompanied by simultaneous cooling of the monitored surface area under measurement and consequently may cause impairment of the cooking product and falsification of the measurement result. Published, Japanese Patent Application JP 08021631 A describes a microwave oven in which cool air is introduced into the oven and heated air is removed from the oven by a fan. The microwave oven is equipped with light sensors and bimetallic thermal elements that are disposed in front of the sensors and are cooled by the fan. In the event of operational malfunctions of the fan, the heating element or a temperature control device, the deformation of the bimetallic thermal elements resulting from the heating leads to a switching pulse in the light sensors and ultimately to switching off of the microwave oven. However, this configuration does not allow the progress of the cooking process to be ascertained. It is also not ruled out that the cooking product may be influenced by being exposed to the air supplied.

In the reference titled "Thermopile-IR-Sensormodul zur berührungs-losen Temperaturmessung in Haushaltsgeräten" [Thermopile-IR Sensor Module For Contactless Temperature Measurement In Domestic Appliances], J. Schiefendecker et al., Wiss. Z. techn. Univers. Dresden 43 (1994), issue 6, pages 41–44, a configuration of an infrared sensor module in the top wall of a microwave cooking space is described. In this case, a cooling air flow is conducted essentially parallel to the top wall. This makes it flow past an end wall of the infrared sensor module equipped with a protective filter. It is disadvantageous here, however, that the air flow causes vortices in the region of the protective filter and thereby contributes to the ingress of dirt particles. In addition, this type of air conduction is technically relatively complex.

SUMMARY OF THE INVENTION

It is accordingly an object of the invention to provide a cooking appliance with a temperature sensor which overcomes the above-mentioned disadvantages of the prior art devices of this general type, which allows simple and reliable monitoring of the cooking process while at the same time maintaining the quality of the result of cooking.

With the foregoing and other objects in view there is provided, in accordance with the invention, a cooking appliance, including:

an appliance housing having a cooking space side and a cooking space formed therein for receiving a cooking product;

a cooling-air feeding device disposed in the appliance housing and providing an air stream, the cooling-air feeding device having a mouth formed therein disposed on the cooking space side of the appliance housing;

a sensor module for sensing an infrared radiation of a surface area under measurement, disposed in the cooking space, and disposed at least partially in the air stream provided by the cooling-air feeding device; and an extraction device for extracting air from the cooking space and having a mouth formed therein disposed on the cooking space side, and an imaginary straight line joining the mouth of the cooling-air feeding device and the mouth of the extraction device being at a distance from the surface area under measurement.

The solution according to the invention provides an extraction device for extracting air from the cooking appliance. An extraction device is understood to be any device that actively assists air to leave the cooking space. This makes it possible to act specifically on the cooling air flow.

As a result, the flow moves approximately on an imaginary straight line joining the mouth of the feeding device on the cooking space side and the mouth of the extraction device on the cooking space side. If it is ensured in this configuration that the joining line is kept at a distance from the surface area under measurement, the cooling air stream does not reach the surface area under measurement. This rules out any influence on the result of measurement and on the cooking product.

Deep penetration of the cooling air stream into the cooking space can also be avoided by the mouth of the feeding device on the cooking space side being disposed on the same wall of the cooking space as the mouth of the extraction device on the cooking space side. This applies in particular if the mouth of the feeding device on the cooking space side is disposed next to the mouth of the extraction device on the cooking space side. This effect is intensified if the mouth of the feeding device on the cooking space side surrounds the mouth of the extraction device on the cooking space side, or vice versa. Introduction of the cooling air stream into the cooking space is avoided entirely if the feeding device opens out on the cooking space side into the extraction device.

Particularly good cooling is obtained if the sensor module is disposed at least partially inside the feeding device or is provided in the cooking space at least near to the mouth of the feeding device on the cooking space side.

If the cross-sectional surface area of the extraction device and the flow velocity (measurable as dynamic pressure) at its mouth on the cooking space side are greater than the cross-sectional surface area of the feeding device at its mouth on the cooking space side, this makes an improved suction effect possible, since the volumetric flow which can be led away tends to be greater than the volumetric flow fed in.

Other features which are considered as characteristic for the invention are set forth in the appended claims.

Although the invention is illustrated and described herein as embodied in a cooking appliance with a temperature sensor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
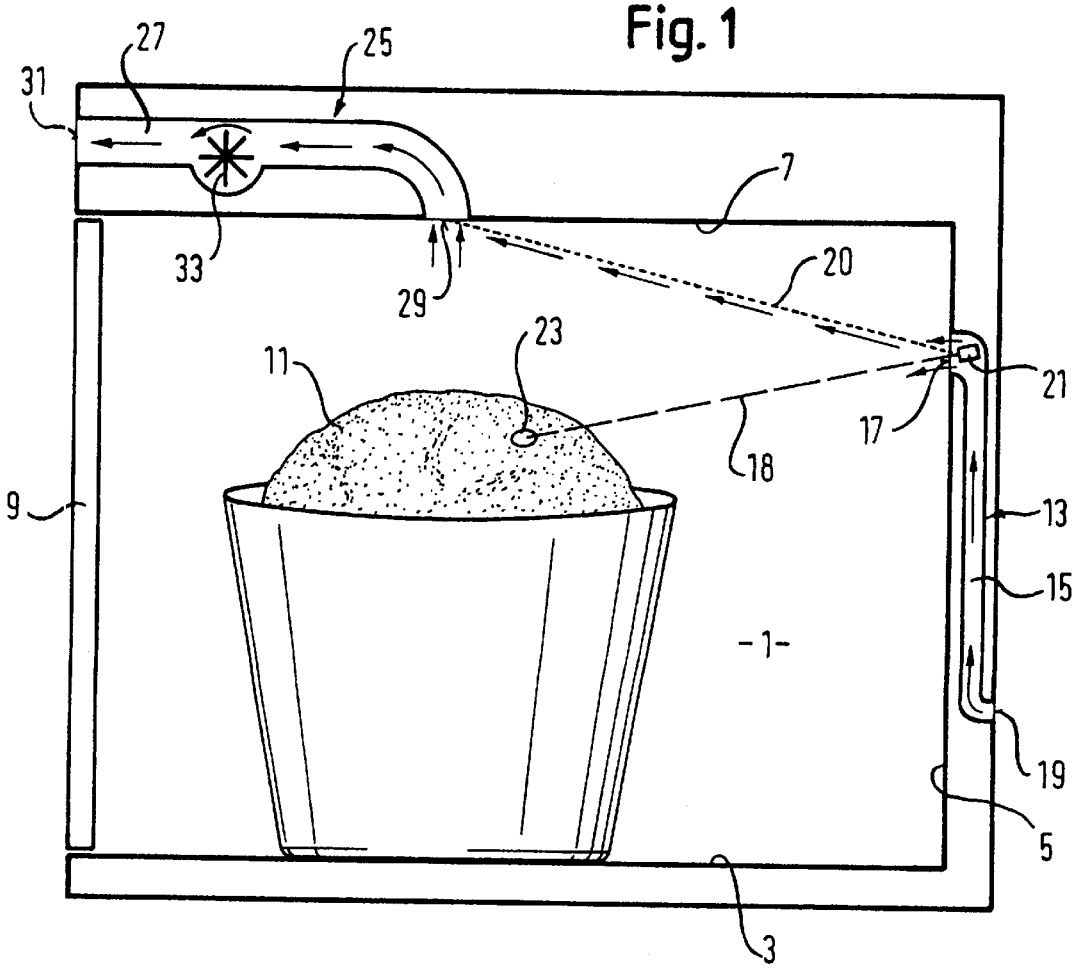
FIG. 1 is a diagrammatic, sectional view through a first embodiment of a cooking appliance according to the invention.

In all the figures of the drawing, sub-features and integral parts that correspond to one another bear the same reference symbol in each case. Referring now to the figures of the drawing in detail and first, particularly, to FIG. 1 thereof, there is shown a cooking appliance that has a heatable cooking space 1, which is externally bounded by a housing formed of sides by walls 3, 5, 7 and a door 9. The cooking space 1 serves for receiving a cooking product 11 to be cooked.

An air-feeding device 13 is provided in the housing 3, 5, 7, 9 of the cooking appliance. The device 13 has an air duct 15, which at one end opens out into the cooking space 1 at a mouth 17 through an opening in the wall 5 and at the other end has a fresh-air feeding opening 19.

A sensor module 21 is provided in the air duct 15 in the region of the mouth opening 17. It is directed through the mouth 17 of the feeding device 13 at a surface area under measurement 23 on the surface of the cooking product 11. The measuring direction is indicated here by a dashed line 18.

The cooking appliance also has an extraction device 25, which is mounted on the side of the top wall 7 facing away from the cooking space 1. The extraction device 25 has an air duct 27, which at one end opens out into the cooking space 1 at a mouth 29 and at its other end has a blowing-out opening 31 in the housing. The extraction device 25 also has a fan 33, which is connected to the air duct 27.

The cooking appliance operates as follows. During the cooking operation, the sensor 21 senses the infrared radiation emitted from the surface area under measurement 23 of the cooking product 11 and passes on the sensed values to non-illustrated evaluation electronics for subsequent evaluation, in order to control the cooking operation in a way known per se according to the settings made by an operator.

During this, the fan 33 transports air from the mouth 29 out of the cooking space 1 through the air duct 27 to the blowing-out opening 31. The lines provided with arrows in the drawings indicate the flow path of the air.

The negative pressure established in the cooking space 1 leads to further air flowing in from the fresh-air feeding opening 19 via the air duct 15 of the feeding device 13. The air thereby flows past the sensor module 21 through the mouth 17 into the cooking space 1.

The suction of the extraction device 25 causes the air entering the cooking space 1 to be directed in the direction of the mouth 29 of the extraction device 25. On its way through the cooking space 1, it therefore follows approximately the imaginary joining line 20, represented by dotted lines, between the mouth 17 of the feeding device 13 and the mouth 29 of the extraction device 25. The air stream is thus kept at a distance from the surface area under measurement 23 and from the cooking product 11 by the extraction device 25 (FIG. 1).

Figure 2:
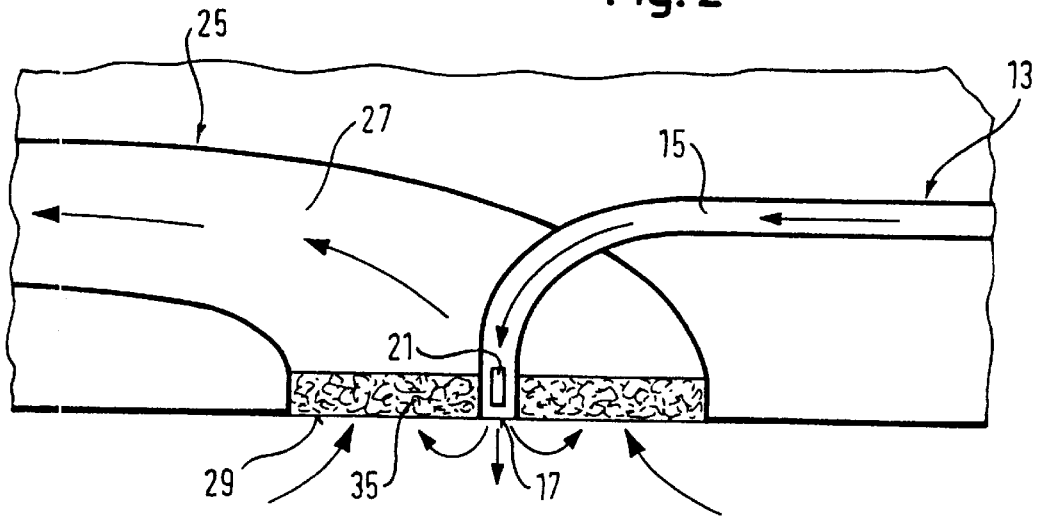
FIG. 2 is a fragmented, longitudinal sectional view through a detail of a wall according to a second exemplary embodiment.

FIG. 2 shows a detail of a second exemplary embodiment. In this exemplary embodiment, the extraction device 25 is configured as a water-vapor discharge. The mouth 29 on the cooking space side is therefore covered by a water-vapor filter 35. The feeding device 13 is in this case disposed in such a way that the air duct 15 opens out into the water-vapor filter 35. The cooling air sucked in through the feeding device 13 can in this case be used in a way known per se for cooling electrical components of the cooking appliances. The mouth 17 of the feeding device 13 is thus surrounded by the mouth 29 of the extraction device 25. In this case, the imaginary straight joining line between the two lies in the surface of the water-vapor filter 35 on the cooking space side. The sensor module 21 is in this case disposed inside the feeding device 13 in the water-vapor filter 35.

The cross-sectional surface area of the mouth 29 of the extraction device 25 corresponds approximately to the surface area of the water-vapor filter 35. It is consequently significantly larger than the cross-sectional surface area of the feeding device 13 at the mouth 17 on the cooking space side. It is also advantageous if the flow velocity at the mouth 29 of the extraction device 25 is greater than that at the mouth 17 of the feeding device 13. As a result, more air is extracted via the extraction device 25 than is fed to the cooking space 1 via the feeding device 13. The cooling air blown through the mouth 17 in the top region then does not penetrate into the cooking space 1 and onto the cooking product 11 but is extracted again immediately by the fan 33.

Figure 3:
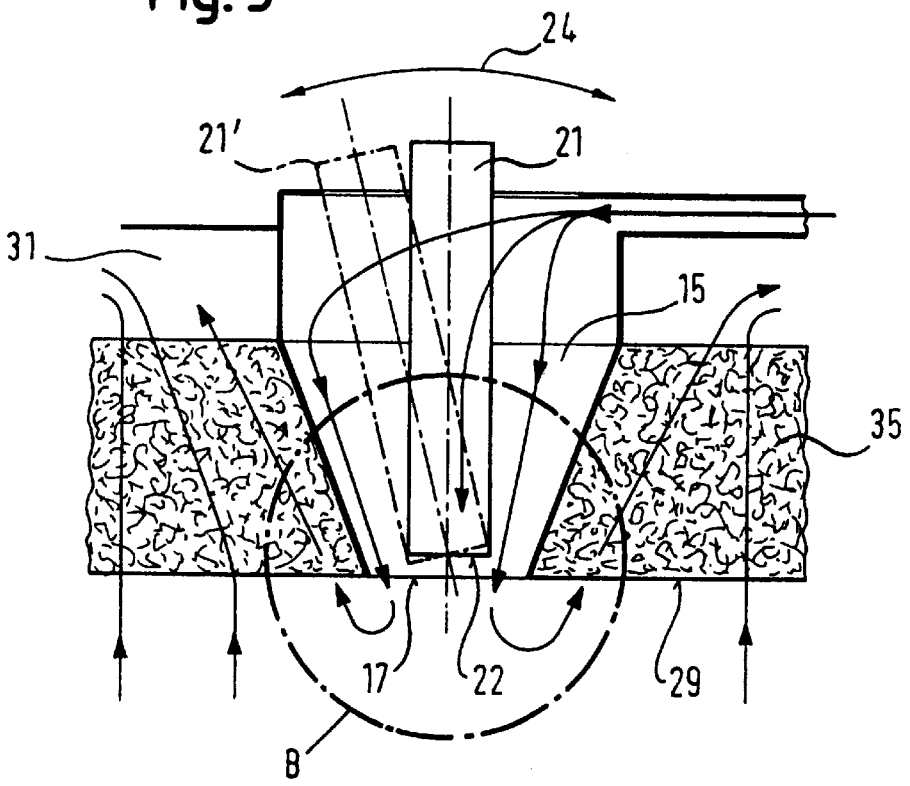
FIG. 3 is a longitudinal sectional view through an advantageous configuration of a mouth of a feeding device according to a third exemplary embodiment.

FIG. 3 shows an advantageous configuration of the mouth 17 of the feeding device 13 corresponding to the embodiment of FIG. 2, according to a first exemplary embodiment.

In this structural configuration, the air duct 15 of the feeding device 13 tapers conically in its end region on the cooking space side toward the mouth 17 and is in this case formed by the water-vapor filter 35. The sensor module 21 is positioned with its end face 22 directly at the mouth 17. As indicated by an arrow 24 and an alternative position 21', the sensor module 21 is in this case pivotably mounted.

The tapering has the effect of accelerating the air stream toward the mouth 17. As a result, the cooling and dirt-repelling effect of the air stream is enhanced, without increasing the volumetric flow.

The pivotability of the sensor module 21 makes it possible to direct the end face 22 at different regions of the cooking space 1 and to perform an exact adjustment of the sensor module 21 to the surface area under measurement 23 respectively to be monitored. As a result, the sensor module 21 can be adapted for ensuring optimum measuring accuracy, for example when the cooking product has been pushed in at different heights. The freedom of movement of the sensor module 21 is in this case helped by the conical shape of the air duct 15 in the water-vapor filter 35.

Figure 4:
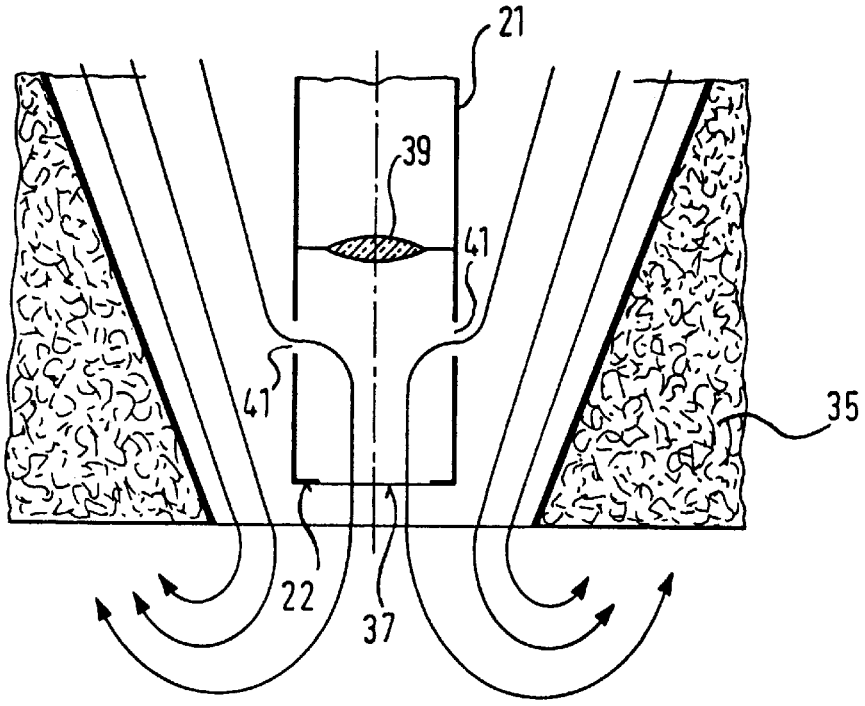
FIG. 4 is a longitudinal sectional view through an advantageous configuration of a sensor module corresponding to detail B of FIG. 3 and according to a fourth exemplary embodiment.

FIG. 4 shows an advantageous configuration of the sensor module 21 on an enlarged scale in a configuration according to a fourth exemplary embodiment.

The sensor module 21, disposed in the mouth region of the feeding device 13, has on the end face 22 an aperture 37. Viewed from the cooking space 1, disposed behind the aperture 37 is a lens 39. Provided laterally in the sensor module 21 between the aperture 37 and the lens 39 are openings 41.

In such a configuration, the cooling air partly flows out of the air duct 15 through the lateral openings 41 into the sensor module 21 and leaves again in the direction of the cooking space 1 at the aperture 37. Therefore, the lens 39 is additionally protected against soiling and overheating.

The pivotability of the sensor module 21 could be restricted to individual parts, such as lens optics for example. In a configuration in which the feeding device 13 opens out on the cooking space side into the extraction device 25, introduction of an air flow into the cooking space 1 could be avoided entirely. After flowing past the sensor module 21, the cooling air would be carried away directly by the extraction device 25, without reaching the cooking space 1. As an alternative to the configuration show, the air feed could have a fan that actively introduces air into the cooking appliance.

We claim:

1. A cooking appliance, comprising:

an appliance housing having a cooking space side and a cooking space formed therein for receiving a cooking product;

a cooling-air feeding device disposed in said appliance housing and providing an air stream, said cooling-air feeding device having a mouth formed therein disposed on said cooking space side of said appliance housing;

a sensor module for sensing an infrared radiation of a surface area under measurement, disposed in said cooking space, and disposed at least partially in the air stream provided by said cooling-air feeding device; and an extraction device for extracting air from said cooking space and having a mouth formed therein disposed on said cooking space side, and an imaginary straight line joining said mouth of said cooling-air feeding device and said mouth of said extraction device being at a distance from the surface area under measurement.

2. The cooking appliance according to claim 1, wherein said mouth of said cooling-air feeding device is disposed next to said mouth of said extraction device.

3. The cooking appliance according to claim 1, wherein said mouth of said cooling-air feeding device is surrounded by said mouth of said extraction device.

4. The cooking appliance according to claim 1, wherein said cooling-air feeding device opens out on said cooking space side into said extraction device.

5. The cooking appliance according to claim 1, wherein said mouth of said cooling-air feeding device has a cross-sectional surface area, and said mouth of said extracting device has a cross-sectional surface area at least as large as said cross-sectional surface area of said mouth of said cooling-air feeding device.

6. The cooking appliance according to claim 1, wherein a dynamic pressure at said mouth of said extraction device is at least as great as at said mouth of said cooling-air feeding device.

7. The cooking appliance according to claim 1, wherein said cooling-air feeding device has an air duct with an end region facing toward said cooking space, and at least said end region tapers toward said mouth of said cooling-air feeding device.

8. The cooking appliance according to claim 1, including a water-vapor filter, and said sensor module being disposed in said water-vapor filter.

9. The cooking appliance according to claim 1, wherein said sensor module is disposed at least partially inside of said cooling-air feeding device.

10. The cooking appliance according claim 1, wherein said sensor module has openings formed therein for allowing a flow of the air through said sensor module.

11. The cooking appliance according to claim 1, wherein said sensor module is a pivotally disposed sensor module.

12. The cooking appliance according to claim 1, wherein said sensor module has parts that are pivotably disposed.

* * * * *